US007178437B2

(12) United States Patent
Hartmann et al.

(10) Patent No.: US 7,178,437 B2
(45) Date of Patent: Feb. 20, 2007

(54) METHOD AND DEVICE FOR DRAWING-IN A MATERIAL WEB

(75) Inventors: Manfred Wolfgang Hartmann, Elfershausen (DE); Horst Bernhard Michalik, Höchberg (DE)

(73) Assignee: Koenig & Bauer Aktiengesellschaft, Wursburg (DE)

( * ) Notice: Subject to any disclaimer, the term of this patent is extended or adjusted under 35 U.S.C. 154(b) by 244 days.

(21) Appl. No.: 10/479,507

(22) PCT Filed: Jun. 6, 2002

(86) PCT No.: PCT/DE02/02056

§ 371 (c)(1),
(2), (4) Date: Dec. 10, 2003

(87) PCT Pub. No.: WO02/102594

PCT Pub. Date: Dec. 27, 2002

(65) Prior Publication Data

US 2004/0231477 A1 Nov. 25, 2004

(30) Foreign Application Priority Data

Jun. 15, 2001 (DE) ..... 101 28 820

(51) Int. Cl.
*B26D 1/15* (2006.01)

(52) U.S. Cl. ..... 83/107; 226/92

(58) Field of Classification Search ..... 83/107; 34/117, 120; 226/91, 92
See application file for complete search history.

(56) References Cited

U.S. PATENT DOCUMENTS

| | | | | |
|---|---|---|---|---|
| 3,756,527 | A * | 9/1973 | Collins et al. | 242/525.3 |
| 3,764,085 | A * | 10/1973 | Hawkins | 242/526.3 |
| 4,063,505 | A * | 12/1977 | Sasamoto et al. | 101/228 |
| 4,187,968 | A | 2/1980 | Winterholler et al. | |
| 5,809,892 | A | 9/1998 | Kruger et al. | |
| 6,092,801 | A | 7/2000 | Abbadessa et al. | |
| 6,240,843 | B1 | 6/2001 | Kruger et al. | |
| 6,325,266 | B1 * | 12/2001 | Suzuki | 226/92 |
| 6,419,217 | B1 * | 7/2002 | Hartmann et al. | 270/52.12 |

FOREIGN PATENT DOCUMENTS

| | | |
|---|---|---|
| DE | 26 57 789 | 6/1978 |
| DE | 196 21 507 C1 | 9/1997 |
| DE | 197 07 427 A1 | 8/1998 |
| GB | 2 322 361 A | 8/1998 |
| JP | 52-50739 | 4/1977 |
| JP | 53-50488 | 12/1978 |
| JP | 55-101394 | 8/1980 |

* cited by examiner

*Primary Examiner*—Kenneth E. Peterson
(74) *Attorney, Agent, or Firm*—Jones, Tullar & Cooper, PC

(57) ABSTRACT

A web of material is drawn into a printing press. A part of the tip of the web, which is laterally projecting over the edge of the web, is separated lengthwise at least once by the use of a slitting device. A device for accomplishing the drawing in of the web is also disclosed.

1 Claim, 3 Drawing Sheets

METHOD AND DEVICE FOR DRAWING-IN A MATERIAL WEB

FIELD OF THE INVENTION

The present invention is directed to a method and to a device for drawing-in a web of material. A start of a web tip, which extends laterally of the web, is cut off.

BACKGROUND OF THE INVENTION

It is known from DE 196 21 507 C1 to draw paper webs into web-fed rotary printing presses. Paper web draw-in devices are used for this purpose.

DE 26 57 789 A1 describes a device for drawing-in a paper web. A draw-in tip of the web is cut off a draw-in mechanism by a cutting device at the side of the longitudinal former.

SUMMARY OF THE INVENTION

The object of the present invention is directed to providing a method and a device for drawing-in a web of material.

In accordance with the present invention, this object is attained by providing a start of the web tip which is extending laterally past an alignment line of one of the lateral edges of the web. This start of the web tip is cut off the web draw-in assembly. This cut-off start can be grasped by a conveying system and removed. A strip may be cut between the draw-in assembly and the web. A cutting arrangement to accomplish this can be situated upstream of a former roller or on an end of a driveable web guide roller. A disposal station can be provided to dispose of the cut-off start.

The advantages to be gained by the present invention consist, in particular, in that, following the automatic draw-in of a web of material, the fastening assemblies, for example a formed-on paper tip, are automatically cut off the draw-in mechanism, which may be, for example a draw-in chain, at a preselectable location of a machine, which machine may be, for example, a web-fed rotary printing press.

The cut-off of the paper web draw-in tip from the paper web takes place at a fixed location, for example at a combining roller which is located upstream of the entry of the web of material into a former. The draw-in speed can be increased.

BRIEF DESCRIPTION OF THE DRAWINGS

A preferred embodiment of the present invention is represented in the drawings and will be described in greater detail in what follows.

Shown are in.

DESCRIPTION OF THE PREFERRED EMBODIMENTS

Figure 2:
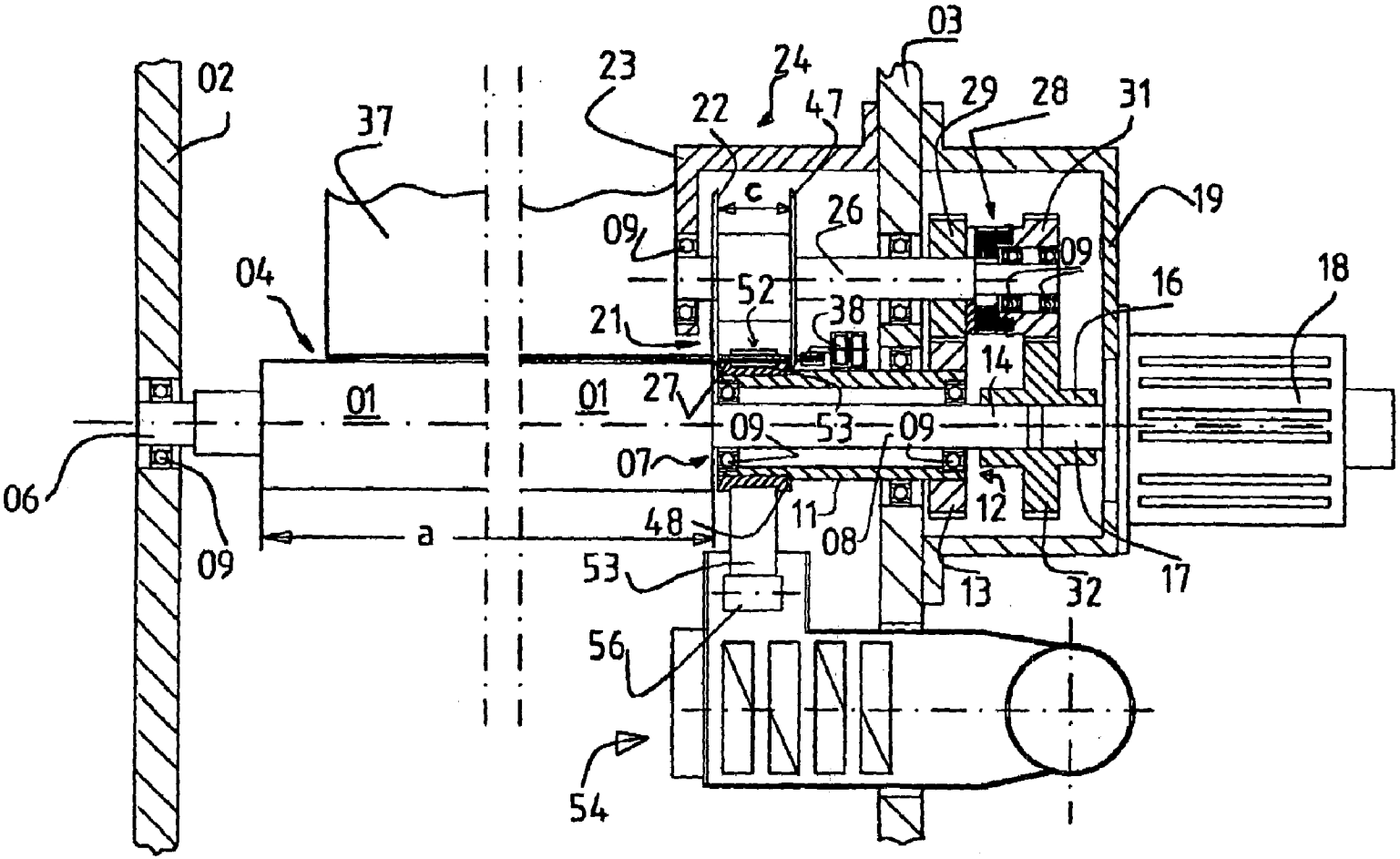

A guide roller 01, for example a paper guide roller 01, is seated or supported on both ends in spaced lateral frames 02, 03, as seen in FIG. 2. The left end 04 of the paper guide roller 01 which has a barrel length "a" is rotatably seated in the lateral frame 02 by the use of a shaft journal 06, while the right end 07 of the paper guide roller 01 has an extended shaft journal 08, which is supported by the use of bearings 09, for example by the use of roller bearings 09, in a sleeve 11, which sleeve 11 is, in turn, seated fixed in the right lateral frame 03 and is arranged coaxially with relation to the shaft journal 08. With its end 12 remote from the guide roller 01, the sleeve 11 projects from the lateral frame 03 and supports a gear wheel 13. The end 14 of the shaft journal 08, which is remote from the roller 01 also projects out of the sleeve 11 and is connected, fixed against relative rotation, via a bushing 16, with the driveshaft 17 of a motor 18, which motor 18 may be, for example, an electric motor 18. The motor 18 is flanged to the exterior of an outer housing 19, which outer housing 19 is fastened on the outer side of the lateral frame 03 that is remote from the roller 01.

A longitudinal cutting arrangement 21 is located outside the barrel length "a" and on an end, such as the right end 07, of the paper guide roller 01. This longitudinal cutting arrangement 21 consists at least of an upper cutter 22, for example a circular cutter 22, which upper cutter 22 is fastened on a driveable cutter shaft 26 extending axis-parallel with the shaft journal 08 and seated in the lateral frame 03, as well as in a wall 23 of an inner housing 24 which is fastened on the inner side of the lateral frame 03; i.e. the side of the lateral frame 03 close to the roller 01.

A cutting edge of the cutter 22 works together with a lower counter cutter 27, for example in the form of a cutter ring located on the end of the sleeve 11 which is close to the roller 01.

While the paper guide roller 01 can be permanently driven by the motor 18 via its shaft journal 08, the upper cutter 22 located on the shaft 26, as well as the counter cutter 27 arranged on the sleeve 11, can also be driven by the provision of a controllable coupling 28, for example a magnetic coupling 28.

The controllable coupling 28 is located inside the outer housing 19 between a cutter shaft gear wheel 29, fastened on the shaft 26, and a coupling gear wheel 31, which is rotatably seated on the shaft 26. The coupling gear wheel 31 meshes with a bushing gear wheel 32 arranged, fixed against rotation, on the bushing 16. All of the various bearings used in this assembly are identified by 09.

The mode of functioning of the longitudinal cutting arrangement 21 depicted in FIG. 2 is as follows:

The paper guide roller 01 is driven when the motor 18 is switched on. The bushing gear wheel 32, which is fixed on the bushing 16, rotates simultaneously with the paper guide roller 01, and meshes with the coupling gear wheel 31, which can freely rotate on the cutter shaft 26. After the coupling 28 is engaged, the cutter shaft 26, with the upper cutter 22, is caused to rotate. At the same time, torque is transmitted from the cutter shaft gear wheel 29, which is fixedly arranged on the cutter shaft 26, to the sleeve gear wheel 13 which is fixed on the sleeve 11, so that the lower counter cutter 27 is also driven and moves along.

The engagement of the coupling 28 can be caused by a sensor, which is not specifically represented. A switched-on time of the coupling 28 can be limited.

Figure 1:
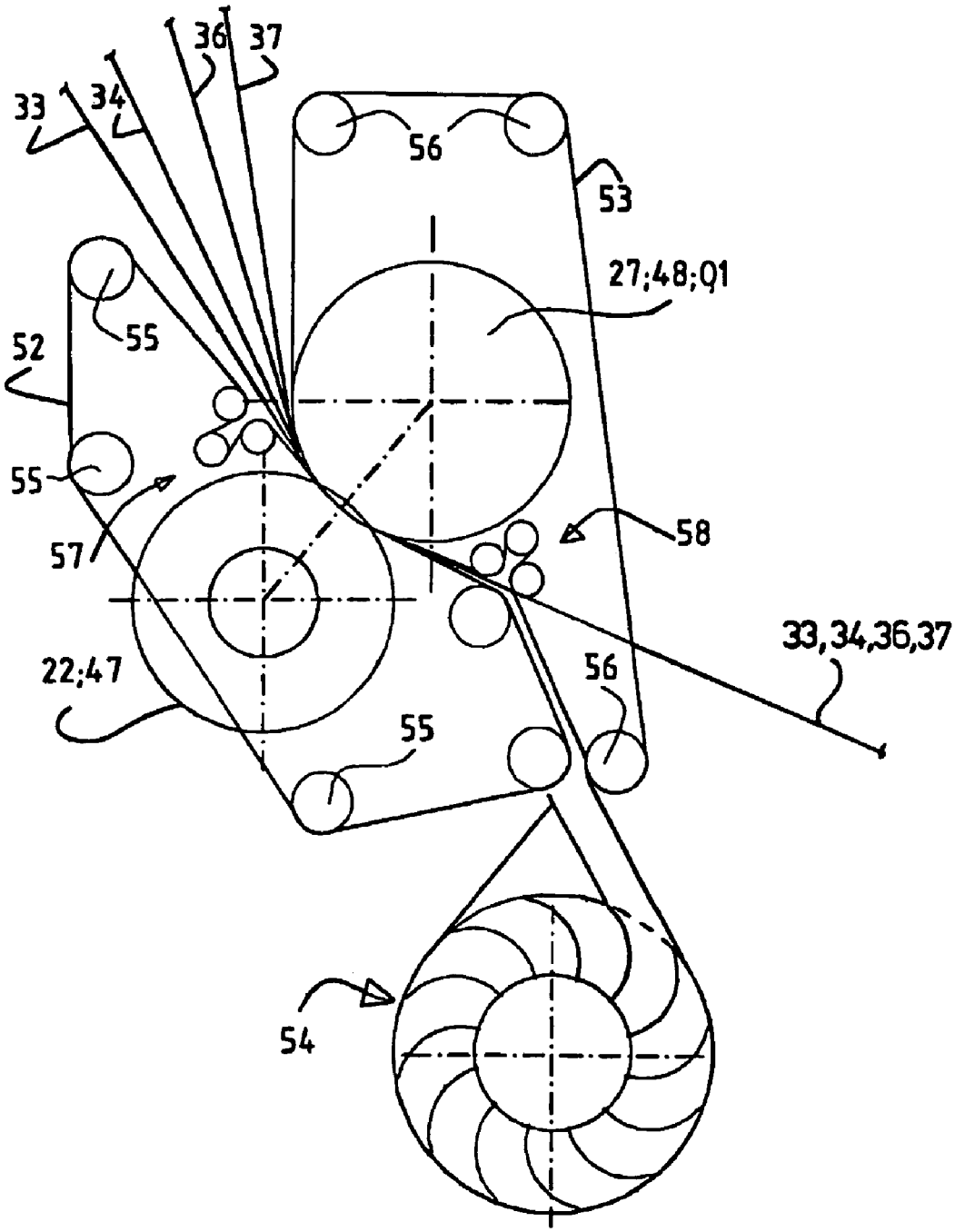
FIG. 1, a schematic representation of a side elevation view of a device in accordance with the present invention without bearing points, in FIG. 2, a front view of the device shown in FIG. 1, but with bearing points, and wherein the shaft of the guide roller is represented as rotated around the shaft of the upper cutter, and in FIG. 3, an enlarged representation of a draw-in mechanism with the tip of a fastening assembly.

The longitudinal cutting arrangement 21, or the paper guide roller 01 with the longitudinal cutting arrangement, is arranged, viewed in the production direction, for example upstream of a former inlet roller of a former, so that the paper guide roller 01 is used as the combining roller for webs of material 33, 34, 36, 37, for example paper webs 33, 34, 36, 37, entering into the former, as may be seen by referring to FIG. 1. In the course of a web draw-in process, the paper webs 33, 34, 36, 37 each reach the paper web guide roller 01 at different times by operation of a draw-in mechanism 39, shown in FIG. 3, and which may be, for example, a finite driven roller chain 39, guided, for example, in a common guide rail 38 fixed on the lateral frame 03. Each one of the several paper webs 33, 34, 36, 37 has on its leading end or tip a fastening assembly 41, for example a glued-on or formed-on paper web tip 41, whose start 59 projects laterally past a lateral or side edge 42, or laterally past an alignment line 61 of the lateral edge 42 of the paper webs 33, 34, 36, 37. This paper web tip start 59 also extends past the area of the barrel length "a" of the paper guide roller 01. The start 59 of the paper web tip 41 is fastened to an extended chain bolt lug or connecting fixture 43 of the roller chain.

If now the paper web tip 41 reaches the now coupled-in and therefore driven longitudinal cutting arrangement 21, an element or segment 46 of the paper web tip 41, which element or segment 46 is delimited by the generated cutting line 44 represented in dash-dotted lines and which element or segment 46 is fastened to the chain bolt 43, is cut longitudinally, i.e. in the production direction, off the paper web tip 41 and is removed by continued operation of the roller chain 39.

Figure 3:
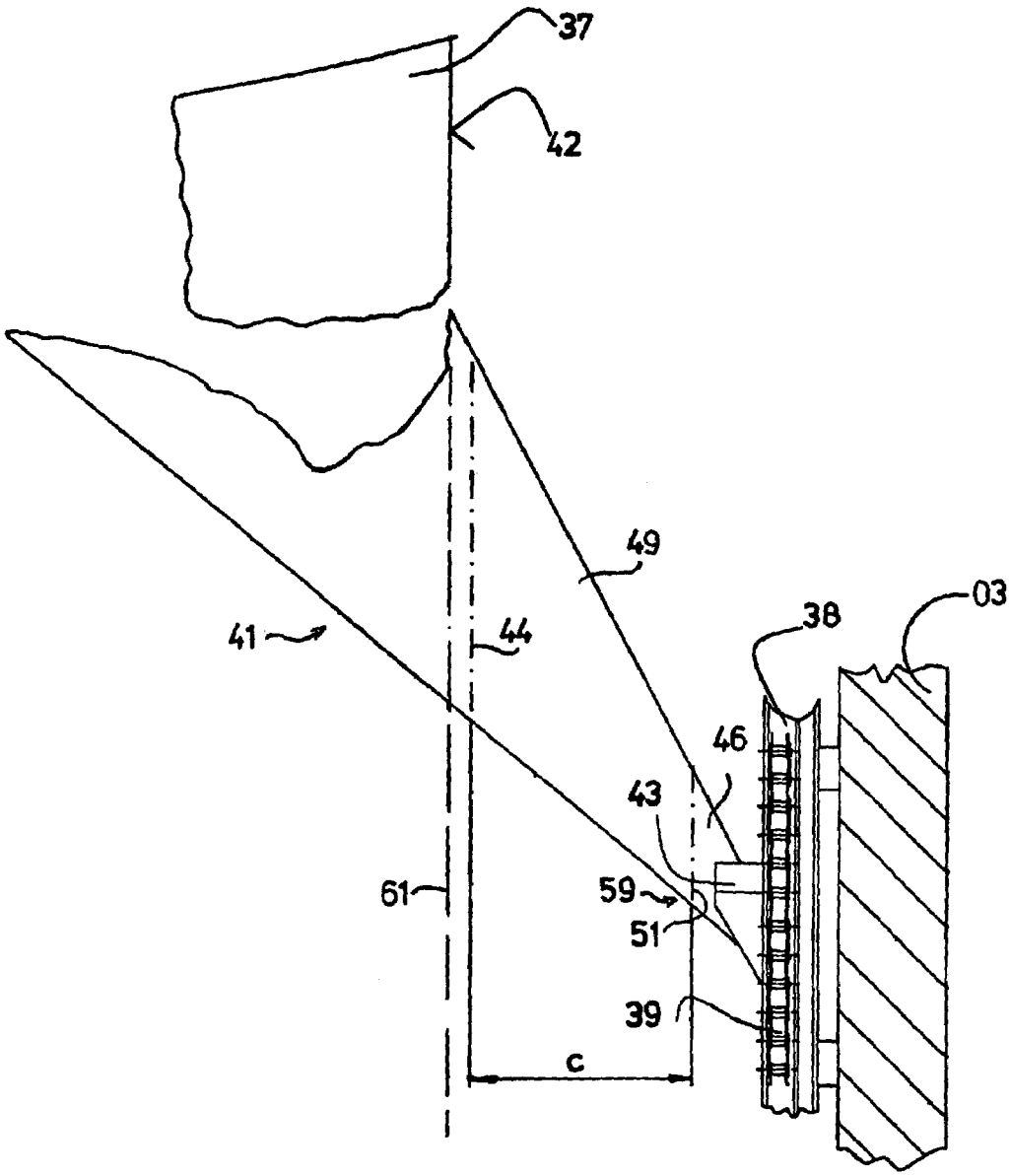

The cutting line 44 of the cutter 22 and the counter cutter 27 extends outside of the paper webs 33, 34, 36 or 37 and in close vicinity of the web lateral edge 42, as seen in FIG. 3. It is also possible to employ a belt system as the draw-in mechanism 39.

In accordance with a second preferred embodiment of the present invention, a second upper cutter 47, as depicted in FIG. 2, is arranged remote from the roller 01 on the cutter shaft 26 at a distance "c" from the first upper cutter 22. This second upper cutter 47 cooperates with a second lower counter cutter 48 located on the sleeve 11. The second upper cutter 47 and the second counter cutter 48 are embodied analogous to the previously described first cutter 22 and first counter cutter 27.

Following the arrival of a paper web tip 41 at the longitudinal cutting arrangement 21 in accordance with the second embodiment, an approximately trapezoidal strip 49 is cut out of the paper web tip 41 by the driven longitudinal cutting arrangement 21, which strip 49 is delimited longitudinally by the cutting line 44 of the first cutter 22 and the first counter cutter 27, as well as by the cutting line 51, created by the second cutter 47 and the second counter cutter 48 and with cutting line 51 extending parallel in respect to cutting line 42 and being represented by dash-dotted lines, as may be seen in FIG. 3.

The cutting lines 44, 51 run in such a way that neither the lateral edge 42 of the paper webs 33, 34, 36, 37, nor the chain bolt 43 are damaged.

In accordance with a third preferred embodiment, this strip 49, or the element or segment 46, which is fastened to the draw-in mechanism 39, can be removed from the draw-in mechanism 39 by two endless conveying or belt systems 52, 53, as seen in FIGS. 2 and 3, which belt systems 52, 53 grip, or clamp the strip 49, or the element or segment 46, and convey it to a disposal station 54, for example. The disposal station 54 can consist, for example, of an aspirating device with an upstream connected comminuting device, which is not specifically represented.

One of the strands of the conveying or belt systems 52, 53 is guided between the first cutter 22 and the first counter cutter 27, or the second cutter 47 and the second counter cutter 48, as shown in FIG. 2, and each belt system 52, 53 runs over deflection rollers 55, 56, as well as through drive and tightening stations 57, 58, respectively.

The gear wheels 31, 32 of the drive mechanism of the longitudinal cutting arrangement 21 are dimensioned in such a way that the circumferential speed of the first upper cutter 22 and the first counter cutter 27 and of the second cutter 47 and the second counter cutter 48 are different, by up to approximately 10%, from the circumferential speed of the paper guide roller 01.

The starts 59 of the paper web tips 41 can be separated one after the other and in any arbitrary sequence from the paper webs 33, 34, 36, 37.

In accordance with a fourth preferred embodiment of the present invention it is also possible to generate a cutting line 44 with the first cutter 22 and with the first counter cutter 27 and to strip the element or segment 46 of the paper web tip 41, which is now only fastened on the chain bolt 43, off the chain bolt 43. Stripping off of the element or segment 46 can be performed by passing the chain bolt 43 over an up ramp, which rises as far as the free length of the chain bolt 43 and which is fixed in place on the lateral frame.

While preferred embodiments of a method and device for drawing in a material web, in accordance with the present invention, are set forth fully and completely hereinabove, it will be apparent to one of skill in the art that various changes in, for example, the type of web being drawn-in, the drive for the draw-in mechanism, the types of bearings used, and the like could be made without departing from the true spirit and scope of the present invention, which is accordingly to be limited only by the appended claims.

What is claimed is:

1. A method for drawing in a web including:

providing a web having a lateral edge;

providing a web tip on said web;

extending a start of said web tip laterally past said web lateral edge;

providing a web draw-in mechanism;

engaging said start of said web tip with said web draw-in mechanism;

using said web draw-in mechanism for drawing said web into a web processing machine;

providing a web start cut-off device in said web processing machine;

cutting said web start from said web in said web start cut-off device;

providing a cut web start conveying system separate from said web draw-in mechanism grasping said cut web start in said cut web start conveying system at said web start cut-off device:

separating said cut web start from said web draw-in mechanism using said cut web start conveying system:

providing a cut web start disposal system located along a path of travel of said cut web start conveying system;

conveying said cut web start to said cut web start disposal system using said cut web start conveying system; and disposing of said cut web start, conveyed to said cut web start disposal system by said cut web start conveying system, in said cut web start disposal system.

* * * * *